United States Patent [19]

Bostrom

[11] Patent Number: 4,561,687

[45] Date of Patent: Dec. 31, 1985

[54] VACUUM GRIP DEVICE

[75] Inventor: Mark W. Bostrom, Melbourne, Fla.

[73] Assignee: Harris Corporation, Melbourne, Fla.

[21] Appl. No.: 615,479

[22] Filed: May 30, 1984

[51] Int. Cl.[4] ..... B66C 1/02; B65H 3/08

[52] U.S. Cl. ..... 294/64.1; 271/90; 221/211; 414/121; 198/689.1

[58] Field of Search ..... 294/64 R, 64 A, 64 B, 294/1 CA; 414/744 B, 752, 737, 627, 121; 198/486, 689; 269/21; 271/90; 221/211

[56] References Cited

U.S. PATENT DOCUMENTS

| | | | |
|---|---|---|---|
| 2,198,765 | 4/1940 | Featherstone et al. | 51/235 |
| 3,084,928 | 4/1963 | Optiz | 269/21 |
| 3,460,822 | 8/1969 | Link | 269/21 |
| 3,595,556 | 7/1971 | Schonauer | 269/71 |
| 3,602,543 | 8/1971 | Sjodin | 294/64 R |
| 3,987,933 | 10/1976 | Ishammar | 221/298 |
| 4,339,297 | 7/1982 | Aigo | 156/345 |
| 4,351,518 | 9/1982 | Stievenart | 294/64.1 |

*Primary Examiner*—James B. Marbert
*Attorney, Agent, or Firm*—Barnes & Thornburg

[57] ABSTRACT

A bi-stable vacuum gripping assembly is provided for workpiece support and retention having base and head portions, conduit means connected therebetween for spacing the head portion from the base portion and for conducting vacuum pressure therebetween, and valve means actuated by contact forces of a workpiece against the head portion sufficient to cause movement of the head portion and compression of the conduit means.

12 Claims, 3 Drawing Figures

VACUUM GRIP DEVICE

BACKGROUND AND SUMMARY OF THE INVENTION

The present invention relates generally to vacuum gripping devices and, more particularly to self-actuating vacuum extractors and locators for handling electronic parts and/or crystalline wafers.

Workholders and extractors have previously employed vacuum devices to hold and handle relatively small or lightweight workpieces. These vacuum devices typically employ some form of gripping orifice which is connected to a fluid sink or low pressure source, such as a vacuum pump. When a portion of the workpiece approaches this orifice, the pressure differential between the orifice and the surrounding atmosphere beyond the workpiece generates a suction force which retains the workpiece against a sealing or contacting surface. Once the workpiece has been engaged by the vacuum device, the workholder may be transported, retaining the workpiece, to different locations. Such workholders may also be employed to fix the workpiece for machining or fabricating operations thereon. In many vacuum devices the orifice is connected directly to the fluid sink such that air flows freely through the orifice when the vacuum pump is operating and the orifice is not covered by workpiece surface.

In multiple workpiece handling apparatus, a plurality of such workholders may be connected in parallel such that the vacuum devices of each share a common fluid sink. However, in operation, such apparatus typically experience a significant loss of vacuum pressure due to the load placed on the common fluid sink system when even a single orifice is left uncovered. To overcome this problem and provide for sufficient vacuum pressure to retain workpieces, larger capacity vacuum pumps and valve means, which permit vacuum pressure to be applied through the orifice only when there is a workpiece to be retained in the immediate vicinity, have been used separately or in combination.

However, to conserve energy and reduce production costs, it is preferable to employ low capacity vacuum pumps and only apply vacuum pressure to the orifice when a workpiece is in contact with it. Current valved orifices typically employ a valve stem extending from the workpiece contacting surface for opening the valve as the workpiece approaches the orifice. However, since the valve is opened prior to contact of the workpiece with the contacting surface, the surrounding atmosphere is permitted to flow freely through the orifice at least for a finite period of time. This may result in significant loss of vacuum pressure in the workholder system. Also, valved orifices typically apply greater localized stresses to the workpiece as it moves into engagement than non-valved vacuum orifices. These increased stresses arise where the surface area of the valve stem in contact with the workpiece is much smaller than the surface area of the workpiece contacting surface.

Another disadvantage of many valved orifices arises when the valve stem is continuously spring biased toward the workpiece. This necessitates the use of vacuum pressure high enough to retain the workpiece as well as overcome the spring bias. Spring biased valve stems also cause the above-mentioned localized stresses to be continuously applied to the workpiece. Further, where the spring bias is provided by a separate coiled spring or leaf spring element, the mechanical complexity and assembly costs of the valve are increased. Bi-stable valves per se are known, but are typically relatively complicated and unsuited for use in vacuum gripping assemblies for multiple workpieces. By "bi-stable valves", the applicant refers to valves which are normally closed but which will stay open after initial actuation without continuous application of the actuation force.

For these reasons, many current vacuum gripping assemblies are undesirable to function in workholders for thin or fragile workpieces, such as crystalline semiconductor disks and electrical circuits formed therefrom.

It is therefore an object of the present invention to provide an improved vacuum gripping means.

Another object of the present invention is the provision of a vacuum gripping assembly which exerts a minimum of localized stresses on the workpiece.

A further object of the present invention is to provide a self-actuating extractor having valve means which is normally closed but which will remain open once actuated for applying vacuum pressure to a workpiece.

Still another object of the present invention is the provision of a vacuum gripping workholder for fragile or thin workpieces using a low capacity vacuum pump.

Yet still another object of the present invention is to provide a vacuum extracting apparatus wherein vacuum pressure is applied to the gripping orifice only when the workpiece is in contact therewith.

These and other objects of the present invention are attained in the provision of a vacuum gripping assembly having base and head portions separated by a flexible conduit and bi-stable valve means for controlling the application of vacuum pressure to the head portion. The valve means is actuated by contact forces of a workpiece against the head portion which are of sufficient magnitude to compress the conduit and open the valve. Once actuated, the valve means remains open by the application of vacuum pressure on the workpiece which is positioned against the workpiece contacting surface in the head portion.

The flexible conduit serves to bias the head portion away from the base portion and conduct vacuum pressure to the head portion. This conduit may include a flexible bellows means and a rigid guide tube to provide lateral support for the bellows. The guide tube also acts as a stop to prevent excessive conduit compression resulting from too large a vacuum pressure or workpiece contact force. The workpiece contacting surface is about the periphery of the vacuum gripping orifice and of sufficient area as to prevent application of undesirable localized stresses to the workpiece. A plurality of these vacuum gripping assemblies may be connected in parallel to a common fluid sink.

Other objects, advantages and novel features of the present invention will become apparent from the following detailed description of the invention when considered in conjunction with the accompanying drawings.

DETAILED DESCRIPTION OF THE DRAWINGS

Figure 1:
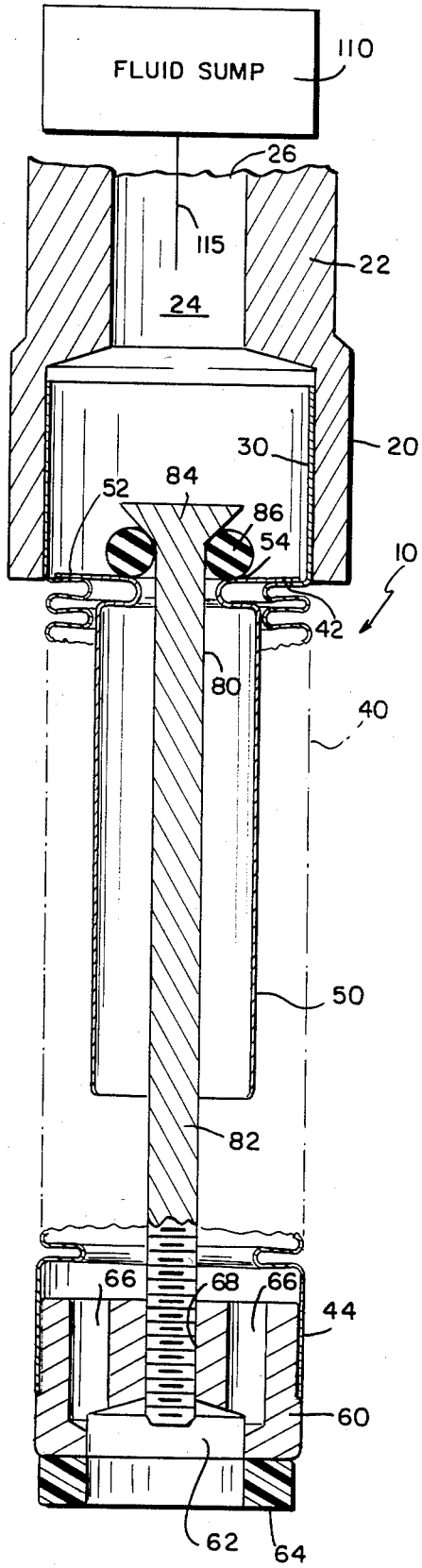
FIG. 1 shows a cross-sectional view of a vacuum gripping assembly according to the principles of the present invention wherein the valve means is closed to prohibit application of vacuum pressure.

FIG. 1, which illustrates in cross-section a preferred embodiment of the present invention, shows a vacuum gripping assembly 10 suitable for workpiece support, retention, and location. Assembly 10 includes base portion 20, flexible conduit 40, head portion 60 and bi-stable valve means 80. Vacuum pressure is applied through vacuum gripping assembly 10 to workpiece 100 from fluid sump 110 (shown in block diagram form). Briefly, air flows through head portion 60, then through flexible conduit 40, then through base portion 20, and along connecting line 115 to fluid sump 110 when valve means 80 is open and sump 110 applies vacuum pressure. Vacuum gripping assembly 10 may be employed, for example, alone or in combination with a plurality of such assemblies to extract or unload packaged integrated circuit devices from burn-in boards and transport these items to a remote mounting location.

Base portion 20 includes a mounting adaptor portion 22 having a fluid passageway 24 therethrough. Port 26 at one end of passageway 24 provides fluid communication with sump 110 through connecting line 115. Base portion 20 further includes extractor base 30 mounted within passageway 24. Although extractor base 30 is illustrated in FIG. 1 as fitting into an enlargement of passageway 24, it should be clearly understood that their relative dimensions may vary with different embodiments of the present invention.

One end of flexible conduit means 40 is connected to extractor base 30 at junction 42. Preferably, extractor base 30 is integrally formed as part of conduit 40. The other end of conduit 40 is connected to head portion 60 at location 44 by any convenient means, such as cement. Guide tube 50 is mounted within extractor base 30 and extends through a portion of conduit 40 toward head portion 60. Guide tube 50 has a base flange 52 which may be connected to conduit 40 adjacent junction 42 by any convenient means, such as cement.

Head portion 60 includes a workpiece gripping orifice 62 for communicating vacuum pressure to a workpiece. Workpiece contacting surface 64 is mounted about the periphery of orifice 62 and provides an airtight seal when in contact with a workpiece. At least one passageway 66 provides fluid communication between orifice 62 and the interior of conduit 40. Head portion 60 further includes a tapped hole 68.

Bi-stable valve means 80 includes a threaded valve stem 82, enlarged valve head 84 at one end of stem 82, and a sealing O-ring 86 mounted about valve head 84. Valve stem 82 and valve head 84 are preferably formed by a machine screw threadedly connected to tapped hole 68. Valve stem 82 passes through flexible conduit 40 and guide tube 50 such that valve head 84 is located in base portion 20. A portion of guide tube flange 52 forms a valve seat 54. When valve means 80 is closed, O-ring 86 forms an airtight seal between valve head 84 and valve seat 54 to restrict the flow of vacuum pressure through base portion 20 to conduit 40.

Means are provided to bias head portion 60 to normally fixed positions away from body portion 20 and thereby bring into and maintain the sealing arrangement of valve head 84, O-ring 86 and valve seat 54. Preferably, this is achieved by including an electro-formed nickle bellows means having an extending bias as an integral part of flexible conduit 40. This arrangement prohibits the application of vacuum pressure to orifice 62 until the extending bias is overcome by a counter-directional force. Since valve means 80 is thus normally closed, a continuously operating low capacity vacuum pump may be employed as sump 110 to achieve sufficiently low vacuum pressures.

To actuate valve means 80 and lift valve head 84 away from sealing engagement with valve seat 54, a sufficiently large counter-directional force must be applied to move head portion 60 relative to valve seat 54. In the embodiment shown in FIG. 1, if a counter-directional force is applied to head portion 60 to oppose the extending bias of conduit 40 by moving head portion 60 toward body portion 20, the counter-directional force must be sufficient to compress conduit 40 along its longitudinal axis. A sufficient counter-directional force may, for example, be supplied when relative motion between assembly 10 and workpiece 100 brings about physical contact of workpiece 100 with contacting surface 64.

Figure 2:
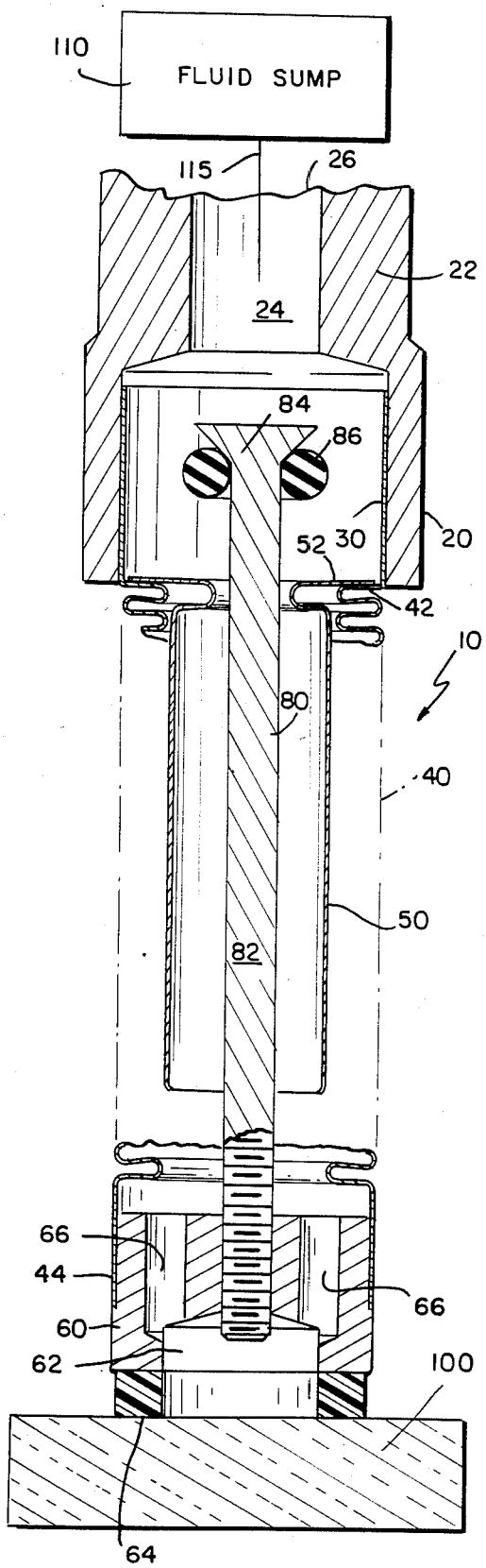
FIG. 2 shows a cross-sectional view of the vacuum gripping assembly of FIG. 1 after contact with the workpiece surface and the resultant valve actuation.

FIG. 2 shows, in cross-section, workpiece gripping assembly 10 after impact with workpiece 100. Valve means 80 has responded to motion of head portion 60 to open a fluid passageway from base passageway 24 through guide tube 50 and conduit 40 to passageways 66 and orifice 62 in head portion 60. Since workpiece 100 completely covers orifice 62 and is in sealing engagement with contacting surface 64 simultaneously or prior to application of vacuum pressure thereto, sump 110 is only exposed to the atmospheric pressure of the air within conduit 40. By preventing exposure to the surrounding atmosphere, no significant load is applied to sump 110 when valve 80 opens.

With regard to actuation of valve 80, since valve stem 82 is a rigid element fixed to head portion 60, a predetermined impact force exerted on head portion 60 by contact with workpiece 100 serves to initially lift valve head 84 and O-ring 86 off of valve seat 54. The application of vacuum pressure to the surface of workpiece 100 adjacent orifice 62 is sufficient to retain the workpiece against head portion 60 without additional counter-directional forces urging relative motion of workpiece 100 toward assembly 10. While the extending bias of flexible conduit 40 is initially overcome by these counter-directional impact forces, the conduit remains compressed since its extending bias is at least balanced by the vacuum pressure applied from orifice 62 through conduit 40 to passageway 24. Thus, valve means 80 forms a bi-stable valve which is normally closed until assembly 10 is in contact with and displaced by workpiece 100. Once head portion 60 is initially displaced and valve 80 is opened, valve 80 remains open as long as assembly 10 is in contact with workpiece 100.

Guide tube 50 acts as a stop means to prevent extreme compression of flexible conduit 40. Such extreme compression could possibly result from the application of an excessive impact force moving assembly 10 and workpiece 100 together or from excessive vacuum pressure exerted on workpiece 100 which moves workpiece 60 beyond the position resulting from initial workpiece impact. Preferably, guide tube 50 is mounted interiorly of flexible conduit 40 such that extreme compression of conduit 40 will result in engagement of head portion 60 against one end of guide tube 50.

The present invention eliminates the need for a valve stem or lever biased against the vacuum pressure to be applied to a relatively small surface area of workpiece 100 either before or during contact with head portion 60. Workpiece engaging surface 64 is provided with a sufficiently large surface area so as to prevent the application of destructive localized stresses against the surface of workpiece 100 adjacent orifice 62. Those stresses that are applied to the surface of workpiece 100 adjacent orifice 62 are substantially uniform over the surface area affected.

Valve head 84 and O-ring 86 may be initially set against valve seat 54 by threadably adjusting valve stem 82 in tapped hole 68 until O-ring 86 just contacts valve seat 64. Continued adjustment of valve stem 82 to shorten its longitudinal length and compress flexible conduit 40 will establish a given pre-loading force which must be overcome to actuate valve 80. When the desired level of adjustment is attained for a given conduit 40, the threaded portion of valve stem 82 may be locked in place and sealed with respect to threaded hole 68.

Figure 3:
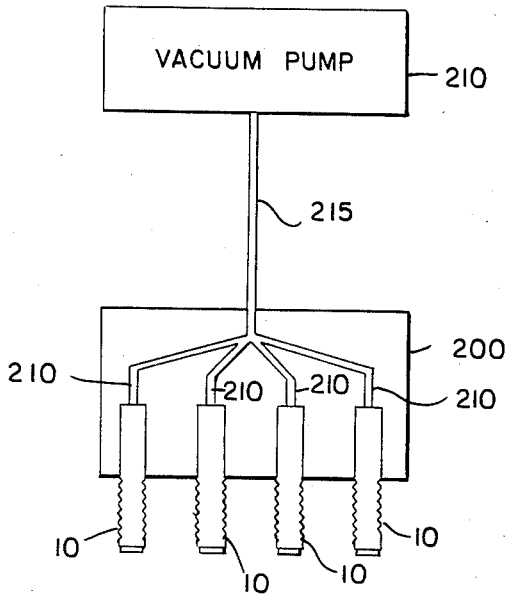
FIG. 3 shows in a block diagram a multiple workpiece handling apparatus wherein a plurality of vacuum gripping assemblies as shown in FIG. 1 are connected in parallel to a common vacuum pressure source.

FIG. 3 shows, in block diagram form, a multiple workpiece handling apparatus 200 formed from a plurality of individual extractor assemblies 10. Vacuum pump 210 functions as a fluid sump or vacuum pressure source and supplies vacuum pressure along connecting line 215 to apparatus 200. Individual extractor assemblies 10 are each provided with supply line 220 connected in parallel to line 215 to provide each of the gripping orifices with vacuum pressure from a common source. As mentioned above, this arrangement permits handling of a plurality of workpieces simultaneously. Further, since vacuum pressure to each cavity is not applied until a workpiece is present, load on vacuum pump 60 is reduced and a lower capacity pump may be employed.

From the preceding description of the preferred embodiments, it is evident that the objects of the present invention are attained, and although the invention has been described and illustrated in detail, it is to be clearly understood that the same is by way of illustration and example only and is not to be taken as a limitation. The spirit and scope of the present invention are to be limited only by the terms of the appended claims.

What is claimed is:

1. A self actuating extractor assembly for vacuum retention of a plurality of workpieces comprising:

a vacuum pressure source;

head means, having fluid connection with said vacuum pressure source, for engaging and holding workpieces;

base means, structurally connected to said head means for supporting said head means; and valve means, connected to said head means so that movement of said head means creates a corresponding movement of said valve means, for controlling flow through said fluid connection.

2. The self-actuating extractor assembly according to claim 1 wherein said valve means is operably associated with said head and base means so as to be bi-stable such that flow through said fluid connection is prevented until said head means moves with respect to said base portion, and flow remains permitted thereafter without further motion of said head means.

3. The self-actuating extractor assembly according to claim 1 wherein said motion of the head means with respect to the base means is caused by contact of one of said workpieces with said head means.

4. A vacuum gripping extractor means for workpiece support comprising:

a base portion;

a head portion;

a vacuum pressure source connected to said base portion;

a flexible conduit between said head and base portions for biasing said head and base portions apart to normally fixed positions and for conducting vacuum pressure from said base to said head portion; and valve means directly connected to said head portion and actuated by engagement of a workpiece with said head portion to overcome said biasing for controlling the flow of vacuum pressure to retain said workpiece to said head portion.

5. The vacuum gripping extractor means according to claim 4 wherein said valve means is actuated by engagement of said workpiece with sufficient force to longitudinally compress said flexible conduit.

6. The vacuum gripping extractor means according to claim 4 wherein said head portion includes a vacuum orifice having a workpiece contacting surface about its periphery, and the surface area of said contacting surface is sufficiently large so as to minimize the application of localized stresses to the workpiece.

7. A bi-stable vacuum gripping extractor for workpiece support and retention comprising:

a base portion;

a head portion;

conduit means connected to and between said base and head portions for conducting vacuum pressure therebetween; and valve means connected to said head portion so that movement of said head means by a predetermined contact force of a workpiece against said head portion is sufficient to cause said head portion to be moved relative to said base portion and a corresponding movement of said valve means.

8. The bi-stable vacuum gripping extractor according to claim 7 wherein said conduit means includes bellows means flexible in the direction of said relative motion of the head portion.

9. The bi-stable vacuum gripping extractor according to claim 7 wherein said conduit means includes stop means to restrict excessive motion of said head portion with respect to said base portion.

10. The bi-stable vacuum gripping extractor according to claim 9 wherein said stop means includes an integral guide tube forming a valve seat at one end thereof and engagable with said head portion to restrict said motion relative to the base portion.

11. The bi-stable vacuum gripping extractor according to claim 7 wherein said valve means is further actuated to an open position by motion of said head portion against said conduit means to compress said conduit means longutudinally.

12. A self-actuating extractor assembly for vacuum retention of a plurality of workpieces comprising:

a plurality of extractor means connected in parallel to a common low pressure source; and each of said extractor means including a base portion, a head portion for holding said workpiece, fluid connection means between said base and head portions, and valve means connected to said head portion so that movement of said head means creates a corresponding movement of said valve means, for controlling low pressure fluid flow thereto through said fluid.

* * * * *